US007381193B2

(12) United States Patent
Nogami

(10) Patent No.: US 7,381,193 B2
(45) Date of Patent: Jun. 3, 2008

(54) TUNNING FORK TYPE THERAPEUTIC UTENSIL

(75) Inventor: Hiroshi Nogami, Shizuoka (JP)

(73) Assignee: Drainage Academy Limited Company, Tokyo (JP)

( * ) Notice: Subject to any disclaimer, the term of this patent is extended or adjusted under 35 U.S.C. 154(b) by 0 days.

(21) Appl. No.: 10/475,417

(22) PCT Filed: Apr. 23, 2002

(86) PCT No.: PCT/JP02/04015

§ 371 (c)(1),
(2), (4) Date: Nov. 12, 2003

(87) PCT Pub. No.: WO02/087488

PCT Pub. Date: Nov. 7, 2002

(65) Prior Publication Data

US 2004/0143200 A1 Jul. 22, 2004

(30) Foreign Application Priority Data

Apr. 23, 2001 (JP) ..... 2001-124261

(51) Int. Cl.
*A61H 1/00* (2006.01)

(52) U.S. Cl. ..... 601/46; 601/84; 84/457

(58) Field of Classification Search ..... 601/46, 601/80, 84, 85; 84/457
See application file for complete search history.

(56) References Cited

U.S. PATENT DOCUMENTS 329,090 A * 10/1885 Segrove ..... 84/457
1,715,324 A * 5/1929 Haglund ..... 84/457
2,529,430 A * 11/1950 Stanton ..... 84/457
2,556,342 A * 6/1951 Dickran ..... 84/409
3,659,230 A * 4/1972 Tanaka et al. ..... 333/200
4,037,121 A * 7/1977 Nakamura et al. ..... 310/321
4,411,161 A * 10/1983 November ..... 73/861.03
4,413,179 A * 11/1983 Matsuoka et al. ..... 250/232
4,892,017 A * 1/1990 Kennedy et al. ..... 81/492
4,934,222 A * 6/1990 Rittmann et al. ..... 81/427.5
6,155,887 A * 12/2000 Cuff et al. ..... 439/751

FOREIGN PATENT DOCUMENTS

JP 17705/1994 3/1994
JP 2000-107250 4/2000

* cited by examiner

*Primary Examiner*—Michael A. Brown
(74) *Attorney, Agent, or Firm*—Jordan and Hamburg LLP

(57) ABSTRACT

The U-shaped base of a U-shaped vibrating element 1 is provided with a transmission rod integrally attached thereto. Further, the transmission rod 2 is attached with a grip portion 3, which in turn is integrally attached with a press member 4 to be pressed against affected areas of patients. Thus constructed, it is possible to provide a tuning fork type therapeutic utensil inexpensive, easy to handle and providing remarkable curing effects not only for the surfaces of the body but also deep and extensively into the body as far as into the osseous tissues.

7 Claims, 6 Drawing Sheets

(A)

(B)

(C)

(A)

(B)

TUNNING FORK TYPE THERAPEUTIC UTENSIL

BACKGROUND OF THE INVENTION

The present invention relates to a tuning fork type therapeutic utensil which is used for lessening symptoms such as swollen lymph glands, stiff shoulders or the like.

Conventionally, healing art such as massaging or acupressure is done manually or by use of tools for lessening lymph glands, stiff shoulders or the like.

However, such conventional healing art imposes such a strain to massagers or acupressure therapists that repetitive and long time attendance on a number of patients is unbearable to them. Even if conventional tools are used for such purposes, there are problems that not only therapeutic effects can be insufficient but also such tools are in many cases too expensive. The conventional electric therapeutic tools, for example, could only offer therapeutic effects to portions near the patient's body surface.

The present invention has been made to solve the above problems and its object is to provide a tuning fork type therapeutic utensil which is inexpensive, handy and capable of showing remarkable therapeutic effects on a wide variety of symptoms for not only around the body surface but also deep into the osseous tissues.

BRIEF SUMMARY OF THE INVENTION

The tuning fork type therapeutic utensil according to the present invention is characterized by comprising a U-shaped vibrating element, a transmission rod extending from a base of the U-shaped vibrating element and a pressing member attached to a tip end of the transmission rod and further by including a grip provided the transmission rod.

DETAILED DESCRIPTION OF THE INVENTION

Hereinafter, embodiments of the present invention will be explained with reference to the drawings.

Figure 1:
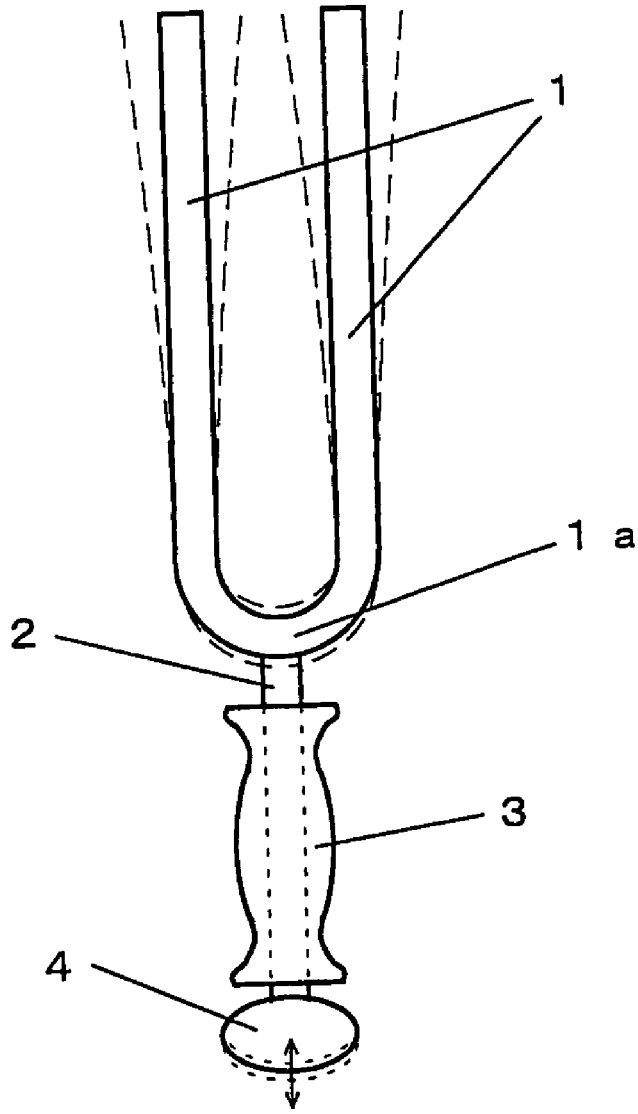
FIG. 1 is an explanatory view of the tuning fork type therapeutic utensil of one embodiment of the invention.

In FIG. 1, the numeral 1 denotes a U-shaped vibrating element made of for example ferrous metal materials such as steel, stainless steel or alloy materials; non-ferrous metal materials such as aluminum, brass, bronze or alloys thereof.

When struck by a hammer, the U-shaped vibrating element are caused to vibrate at a certain frequency as shown in a broken line. The base 1*a* of the vibrating element 1 is curved in the form of the letter U.

The U-shaped base 1*a* of the vibrating element has a transmission rod 2 integrally formed or attached. It is preferred that the transmission rod 2 is generally orientated in the direction of the normal line of the U-shaped base 1*a* (a line perpendicular to the tangent line thereof) in the interest of the transmission of vibration. The transmission rod 2 is also made of a metal similar to the vibrating element 1.

A grip section 3 is attached to the transmission rod 2 therearound. The grip section 3 may be made of any material so long as it provides an easy grip by one hand and in a form or material which minimizes the damping of the vibration of the transmission rod 2; for example rubber or wooden materials are preferably used.

The transmission rod 2 has a press member 4 integrally formed or attached to a tip end thereof. The press member 4 may be made of any materials so long as it has a function to transmit the vibration therefrom when pressed against the affected area directly or indirectly with a piece of cloth therebetween, for example, the material may be suitably selected from metal, plastic, rubber, wood or the like.

Thus constructed, the tuning fork type therapeutic utensil of the invention is caused to vibrate laterally as shown by the broken line in FIG. 1 at a predetermined frequency (preferably 50-200 Hz) when the U-shaped vibrating element 1 is hit by a hammer. When the vibrating element vibrates laterally, the U-shaped base portion 1*a* vibrates longitudinally in the direction perpendicular thereto. The amplitude of the longitudinal vibration of the U-shaped base portion 1*a* is limited as compared to that of the lateral vibration of the vibrating element 1 though the vibration impact thereof is strong enough to such an extent to make the pressing member 4 to vibrate in the arrow-marked directions forcefully and positively.

Figure 2:
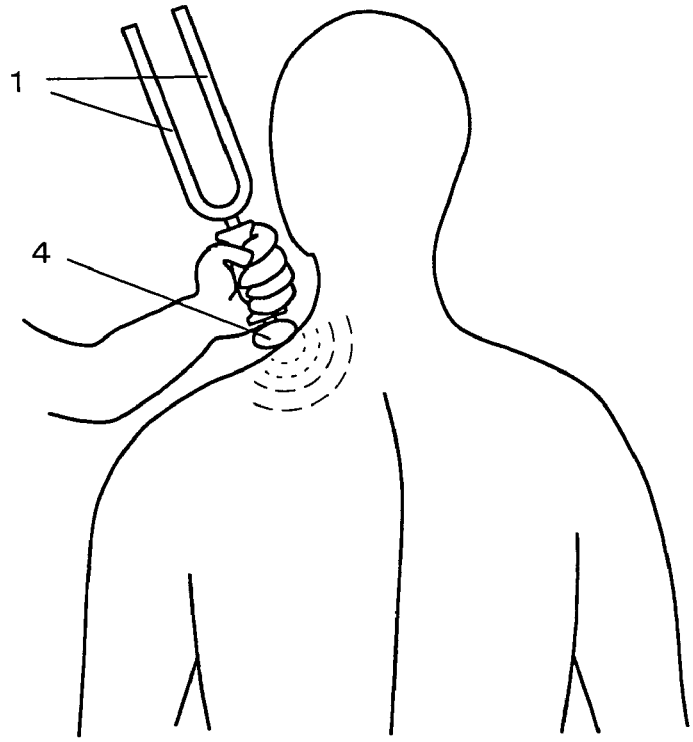
FIG. 2 shows the tuning fork type therapeutic utensil of FIG. 1 being used.

If the thus vibrating press member 4 is pressed against affected areas of the patient as shown in FIG. 2, the vibration works on the affected areas to show various curing effects such as removing stasis including retention or congestion, unstiffening mussels, or the like.

Examples of clinical effects by the tuning fork type therapeutic utensil of the invention may be listed as follows.

1) Lymph fluid clogging was solved by "strong wave emitted by the tuning fork" to make the patient's body slim by removing swells. Further, the lymph fluid was made normal such that the inherent function of the patient's immune system are restored against viruses, bacterial pathogens or the like.

2) Muscle pains were removed by pressing the tuning fork against the affected areas.

3) When the tuning fork was pressed against the aching repeatedly, the pain was relieved for the patient to walk keeping a good posture.

4) When the tuning fork was pressed against a patient's right ear with a severe hearing impairment for ten minutes, the patient had come to turn his right ear in response to another person's words.

5) When the tuning fork was pressed against an affected area between the scalp and the rear of an ear, the patient's headache was relieved.

6) When the tuning fork was pressed against an aching head for about ten minutes, the headache was relieved.

7) When the tuning fork was pressed against a seriously aching portion at the base of a thumb, the pain was relieved.

8) When the tuning fork was pressed against the coccygeal bone twice, the bowel movement of the patient was improved the next day.

9) When the tuning fork was pressed against the areas surrounding the eyes of a computer programmer suffering from impaired vision due to long time watch of the monitor, the eyesight was improved.

10) When the tuning fork was pressed against patients suffering from cataract or glaucoma, its improvement was observed.

11) When the tuning fork was pressed against deformed portions of the patient's face, the deformation was straightened.

Figure 3:
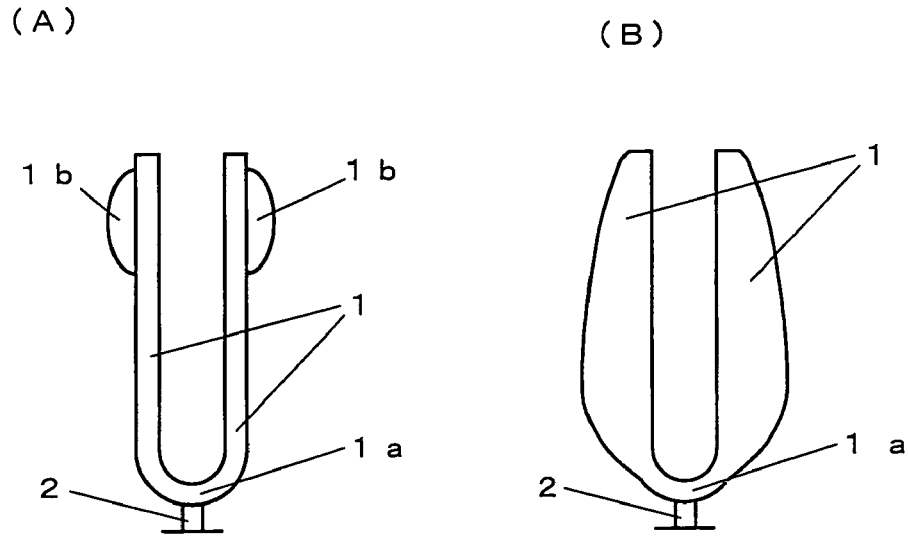
FIG. 3 is an explanatory view of the tuning fork type therapeutic utensil according to another embodiment of the present invention.

FIG. 3(A) and FIG. 3(B) show other embodiments of the U-shaped vibrating element; that is, poise members 1*b* are attached to the upper outside portions thereof as shown in FIG. 3(A) and a tuning fork having a bulky size was prepared as shown in FIG. 3(B).

Figure 4:
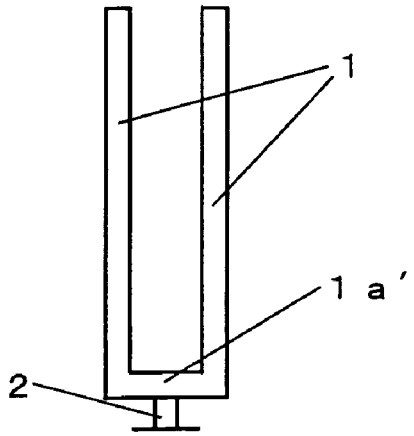
FIG. 4 is an explanatory view of the tuning fork type therapeutic utensil according to a further embodiment of the present invention.
Figure 4:
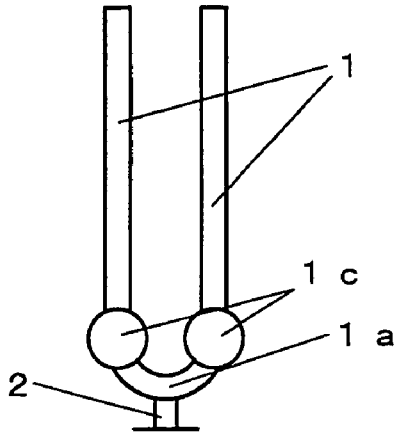
Figure 4:
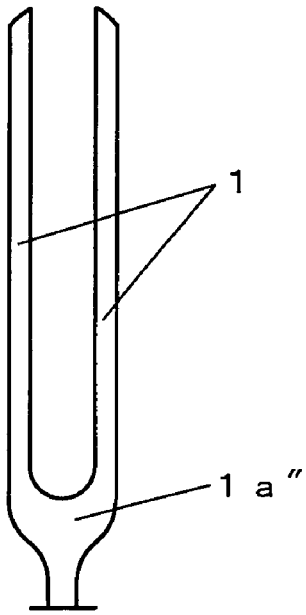

FIGS. 4(A) and 4(B) show further embodiments of the U-shaped vibrating element; that is, the base section 1*a*' is formed with right-angled corners as shown in FIG. 4(A), large diameter stationary portions 1*c* are formed between the vibrating element 1 and the base portion 1*a* thereof as shown in FIG. 4(B), and the U-shaped base portion 1*a*" are generally formed thicker as shown in FIG. 4(C) such that the vibration from the vibrating element 1 is received by the U-shaped base portion effectively.

Figure 5:
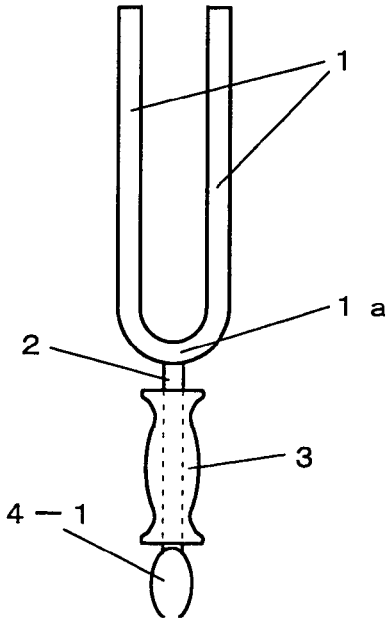
FIG. 5 is an explanatory view of the tuning fork type therapeutic utensil according to a still further embodiment of the present invention.
Figure 5:
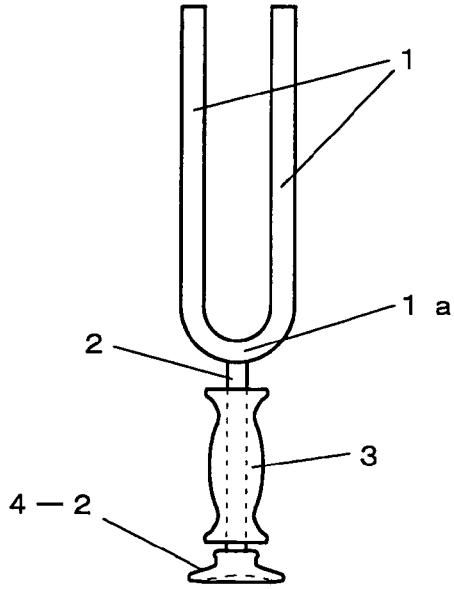

FIGS. 5(A) and 5(B) show still further embodiments of the U-shaped vibrating element; that is, the press portion 4-1 is provided in the form of a substantially elliptic member having a somewhat pointed tip to provide a locally concentrated curing effect as shown in FIG. 5(A), the press portion 4-1 is provided in the form of a substantially flat member as shown in FIG. 5(B) to provide effective variations in terms of size; that is, a small size one (having a diameter of about 10 mm) is for the face, a medium size one (having a diameter of about 25 mm) is for the head, and a large size one (having a diameter of about 30 mm) is for the upper or lower back and legs.

Figure 6:
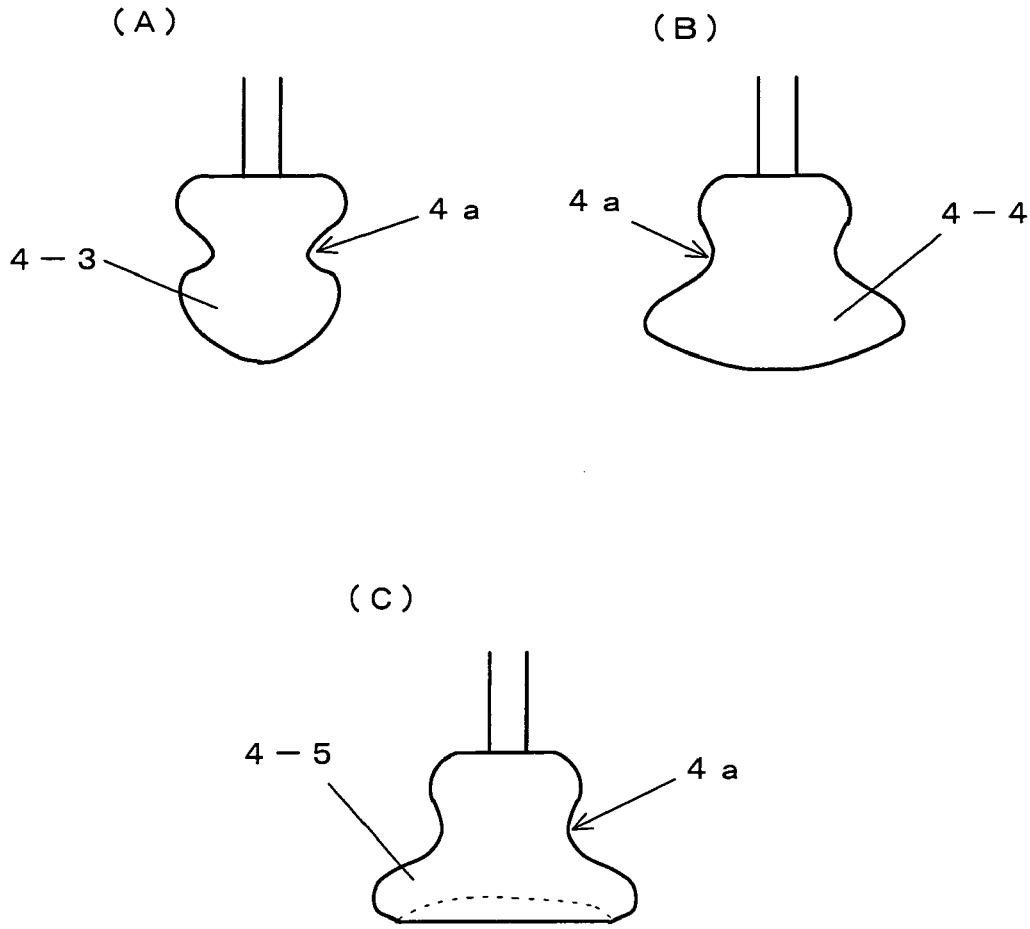
FIG. 6 is an explanatory view of a still further embodiment having a modified pad.

It is to be noted that the grip portion 3 may be omitted because the therapist can grip the transmission rod 2 directly. Otherwise, as shown in FIGS. 6(A), 6(B) and 6(C), the press member 4 is formed with an annular recess 4*a* at an intermediate portion thereof to provide a grip for fingers for helping press the press member 4 against affected areas. FIG. 6 (A) shows a press member having a pointed pressing portion 4-3, FIG. 6 (B) shows a press member having a substantially extended rounded pressing portion 4-4, and FIG. 6(C) shows a press portion having a recessed pressing portion 4-4. All these modifications are selectively used for the symptom of affected areas.

Figure 7:
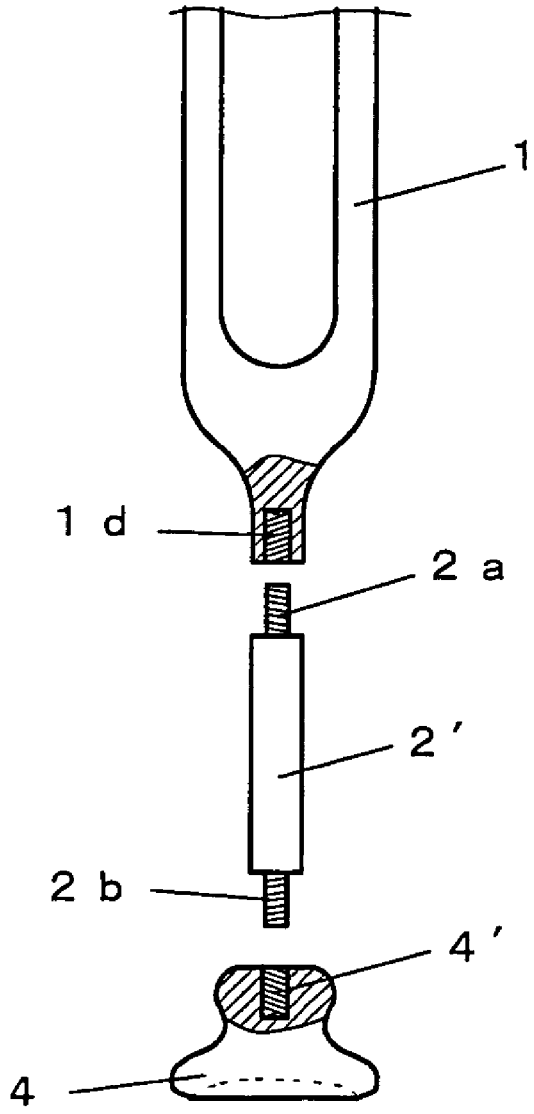
FIG. 7 is an explanatory view of a vibrating element and a pad being connected by a transmission rod.

It is also acceptable to have a still further embodiment as shown in FIG. 7, in which the vibrating element 1, the transmission rod 2' and the press member 4 are separately prepared with the transmission rod 2' having opposite ends thereof formed with screws 2*a* and 2*b* such that the screw 2*a* is adapted to be detachably screwed into a female screw 1*d* formed in the base portion of the vibrating element 1 while the male screw 2*b* is adapted to be detachably screwed into a female screw 4' formed in the press portion 4'.

As discussed above, the present invention provides a tuning fork type therapeutic utensil inexpensive, easy to handle and providing remarkable curing effects not only for the surfaces of the body but also deep and extensively into the body as far as into the osseous tissues.

The invention claimed is:

1. A tuning fork type therapeutic utensil comprising:

a U-shaped vibrating element;

a transmission rod attached to said U-shaped vibrating element at a base thereof, said transmission rod having a longitudinal axis;

means for pressing and vibrating against affected areas, said means including a press member attached to said transmission rod at a tip end thereof, said press member vibrating along said longitudinal axis of said transmission rod;

a grip accommodating a hand of a user, surrounding the transmission rod and constituted of material different from that of the U-shaped vibrating element and which does not substantially damp vibrations transmitted from the vibrating element to the press member through the transmission rod; and connectors for connecting said press member to said rod and said rod to said base.

2. The tuning fork of claim 1 wherein said grip is constituted of rubber or wood.

3. The tuning fork of claim 1, wherein said connectors comprise opposing male and female threads.

4. A tuning fork type therapeutic utensil comprising:

a U-shaped vibrating element;

a transmission rod attached to said U-shaped vibrating element at a base thereof, said transmission rod having a longitudinal axis;

a press member attached to said transmission rod at a tip end thereof, said press member being adapted for pressing against affected areas and for vibrating along said longitudinal axis of said transmission rod;

a grip accommodating a hand of a user, surrounding the transmission rod and constituted of material different from that of the transmission rod and which does not substantially damp vibrations transmitted from the vibrating element to the press member through the transmission rod; and connectors for connecting said press member to said rod and said rod to said base.

5. The tuning fork of claim 4 wherein said connectors comprise opposing male and female threads.

6. The tuning fork of claim 1 or 4, wherein said tuning fork has poise members attached thereto.

7. The tuning fork of claim 1 or 4, wherein the press member comprises a pair of elongated members together forming an ellipse having a space between free ends of the members, the ellipse having a major axis coincident with said longitudinal axis of said transmission rod.

* * * * *